US005451311A

United States Patent [19]

Swain et al.

[11] Patent Number: 5,451,311

[45] Date of Patent: Sep. 19, 1995

[54] ENDLESS BELTS INCORPORATING THICKENED BANDS

[75] Inventors: Eugene A. Swain; Gary J. Maier, both of Webster; Andrew R. Melnyk, Rochester; Geoffrey M. T. Foley, Fairport, all of N.Y.

[73] Assignee: Xerox Corporation, Stamford, Conn.

[21] Appl. No.: 165,123

[22] Filed: Dec. 10, 1993

[51] Int. Cl.[6] ..... C25D 1/02

[52] U.S. Cl. ..... 205/73; 205/67; 204/279; 204/281

[58] Field of Search ..... 205/67, 73, 68, 75, 205/77; 204/279, 281, DIG. 7, 76, 70; 474/272, 270

[56] References Cited

U.S. PATENT DOCUMENTS

| | | | |
|---|---|---|---|
| 1,600,257 | 9/1926 | Topping | 205/76 |
| 2,018,471 | 10/1935 | Russell | 204/281 |
| 3,022,230 | 2/1962 | Fialkoff | 205/73 |
| 3,378,469 | 4/1968 | Jochim | 204/7 |
| 4,245,491 | 1/1981 | Kondo | 72/254 |
| 4,781,799 | 11/1988 | Herbert et al. | 205/73 |
| 4,950,375 | 8/1990 | Leger | 204/224 R |
| 5,127,885 | 7/1992 | Herbert et al. | 474/260 |

*Primary Examiner*—John Niebling
*Assistant Examiner*—Brendan Mee
*Attorney, Agent, or Firm*—Zosan S. Soong

[57] ABSTRACT

Apparatus and process are disclosed for fabricating an endless metal belt comprising a center region between a first end region and a second end region, wherein a portion of the first end region is at least 1.5 times thicker than the center region, thereby resulting in a thickened end portion.

9 Claims, 2 Drawing Sheets

ENDLESS BELTS INCORPORATING THICKENED BANDS

CROSS REFERENCE TO RELATED COPENDING APPLICATION

Attention is directed to the following related application filed concurrently: Geoffrey M. T. Foley et al., "Endless Belts Incorporating Stiffening Members" Ser. No. 08/165,124, now U.S. Pat. No. 5,399,127 filed Dec. 10, 1993 the disclosure of which is totally incorporated by reference.

BACKGROUND OF THE INVENTION

This invention relates generally to endless, preferably seamless, articles or belts and their fabrication. More specifically, the present invention pertains to electrodeposited endless belts incorporating one or two thickened end region portions, which stiffen the belts, and to methods for the fabrication of such stiffened endless belts. The endless belts of the present invention may be used for example in the fabrication of photosensitive or photoconductive imaging members employed in electrostatographic imaging apparatus.

Endless belts, especially seamless, electroformed metal belts, may be thin and flexible. However, thin and flexible belts are difficult to handle without damage when fabricating photosensitive members. Moreover, thin and flexible belts are usually considered unsuitable for equipment designed to handle rigid cylindrical substrates. It is known that during electroforming, there may occur the phenomenon of an "edge effect" wherein the ends of the electroformed article become slightly thickened. For example, the ends may have a thickness up to 1.3 times greater than the thickness of the center portion of the article. Due to the geometry of the plating cell, the top and bottom of the electroformed article may have higher current density areas. These higher current density areas may result in thicker deposits near the ends. This process in which thicker deposits form near the ends of the electroformed article is called the "edge effect." However, even those thin, flexible belts having slightly thickened ends due to "edge effect," are insufficiently rigid or stiff to minimize handling damage when fabricating photosensitive members and are insufficiently rigid or stiff for equipment designed to handle rigid cylindrical substrates. There is a need for a way to temporarily stiffen flexible endless belts to minimize the above problems.

Herbert et al., U.S. Pat. No. 5,127,885, discloses an endless metal belt comprising a center region between two edge regions, wherein the ductility of at least one edge region is greater than the ductility of the center region.

Jochim, U.S. Pat. No. 3,378,469, discloses the use of a rigid backing structure in an electroforming process, reference for example column 4.

SUMMARY OF THE INVENTION

It is an object of the present invention to provide a method and apparatus for temporarily stiffening a thin, endless flexible belt, especially an electrodeposited metal belt.

It is an object to provide an endless belt having a thickened portion in one or both end regions, wherein the thickened portions may be removed to result in a belt having a dimension suitable for use, for example, in a photoconductive imaging member in an electrostatographic imaging apparatus.

It is a further object to provide a thin, flexible endless belt having a thickened portion in one or both end regions to minimize handling damage during fabrication of photosensitive members.

It is an additional object in embodiments to provide a thin, endless belt having a thickened portion in one or both end regions to render the belt suitable for use in equipment designed to handle rigid cylindrical substrates.

These objects and others are accomplished in embodiments by providing an endless metal belt comprising a center region between a first end region and a second end region, wherein a portion of the first end region is at least 1.5 times thicker than the center region, thereby resulting in a thickened end portion.

There is also provided in embodiments an electrodeposition mandrel comprising: (a) a center portion having an electrically conductive surface; (b) a first end portion having an electrically conductive surface disposed adjacent one end of the center portion; and (c) a first electrically insulating layer disposed between the center portion and the first end portion, whereby the first layer minimizes electrical conductivity between the center portion and the first end portion.

There is further provided in embodiments an electrodeposition mandrel comprising: (a) a center portion comprised of a first electrically conductive material; and (b) a first end portion comprised of a second electrically conductive material, integral with one end of the center portion, wherein the second material has a higher electrical conductivity than the first material.

In embodiments, there is additional provided a process comprising: (a) forming on a mandrel a seamless, endless metal article comprised of a center region between a first end region and a second end region, wherein a portion of the first end region and an optional portion of the second end region are at least 1.5 times thicker than the center region; (b) removing the article from the mandrel; and (c) depositing layered material on the article subsequent to (b).

BRIEF DESCRIPTION OF THE DRAWINGS

Other aspects of the present invention will become apparent as the following description proceeds and upon reference to the Figures which represent preferred embodiments.

DETAILED DESCRIPTION

Figure 1:
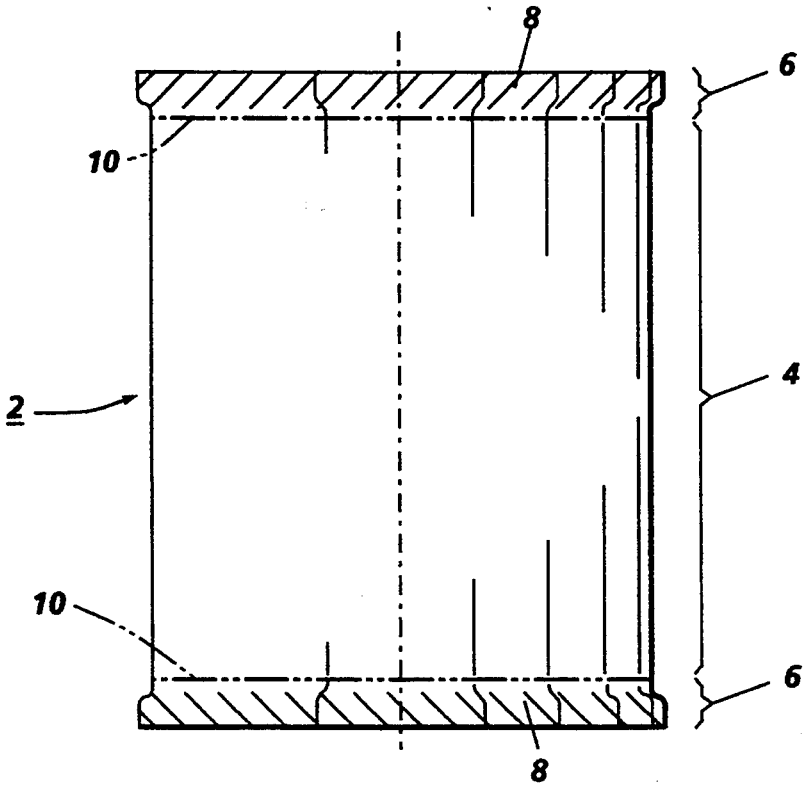
FIG. 1 represents a top view of a seamless, endless metal belt having a thickened band in each end portion.

FIG. 1 discloses belt or article 2 comprised of center region 4 between two end regions 6, each end region 6 having a thickened portion 8. The precise dimensions of the article's center region 4 and end regions 6 may vary in embodiments. In FIG. 1, an illustrative, imaginary boundary 10 between the center region 4 and end regions 6 is represented by phantom lines. For article 2 which may be for example in the form of an endless belt, the end regions 6 include the side edges and a portion of the belt surface adjacent the edges such as that belt surface portion ranging from about 1 to about 20 cm adjacent each edge. In embodiments, the dimensions of each end region is selected so that its removal will result in the remaining center region having the desired dimensions of the belt. The article may incorporate only a single thickened end portion and there may be no need to remove both end regions. Thus, in embodiments, only one end region is removed and the center region and the remaining end region have the dimensions of the desired belt. Although an edge of the thickened end portion 8 may coincide with the boundary 10 between the center region 4 and the end region 6 of the article 2, the edge of the thickened end portion 8 is preferably located at a distance from the boundary 10 such as from about 1 mm to about 5 cm away from the boundary 10. The belt is preferably seamless and the thickened portions in the end regions may be for example in the form of a continuous, thickened band. In embodiments, each thickened end portion corresponds for example to about 20% to 100% of the exterior surface of each end region, and more preferably corresponds to about 30% to about 70% of the exterior surface of each end region.

The belt having one or two thickened end portions has the following illustrative dimensions. The center region and the part of the end regions not including the thickened portions have a thickness preferably ranging from about 10 microns to about 200 microns, and more preferably ranging from about 20 microns to about 100 microns. Each thickened end portion may be for example at least about 1.5 times thicker than the center region, preferably at least about 1.8 times thicker than the center region, more preferably having a thickness ranging from about 2 to about 10 times the thickness of the center region, and especially having a thickness ranging from about 2.5 to about 6 times the thickness of the center region. Each thickened end portion may have a thickness ranging for example from about 15 microns to about 15 mm, and more preferably from about 50 microns to about 5 mm. The two thickened end portions may have the same or different thickness with one another. The belt has a preferred length ranging from about 8 cm to about 200 cm, and more preferably from about 15 cm to about 100 cm. The belt having one or two thickened end portions has a width, as measured from side edge to side edge, ranging for example from about 5 cm to about 100 cm, and more preferably from about 15 cm to about 70 cm. In embodiments where each thickened end region portion is in the form of a continuous, thickened band, the band has a width ranging for example from 1 cm to about 10 cm, and more preferably from about 2 cm to about 5 cm.

To fabricate the endless belts of the present invention, there are provided single piece and multi-section mandrels as disclosed herein having a center portion between a first end portion and a second end portion. The precise dimensions of the mandrel's center portion, first end portion, and second end portion may change in embodiments. For cylindrical mandrels, the end regions may include for example the top and bottom edges and a portion of the mandrel surface adjacent the edges, such as that mandrel surface portion ranging from about 1 to about 20 cm adjacent each edge.

Figure 2:
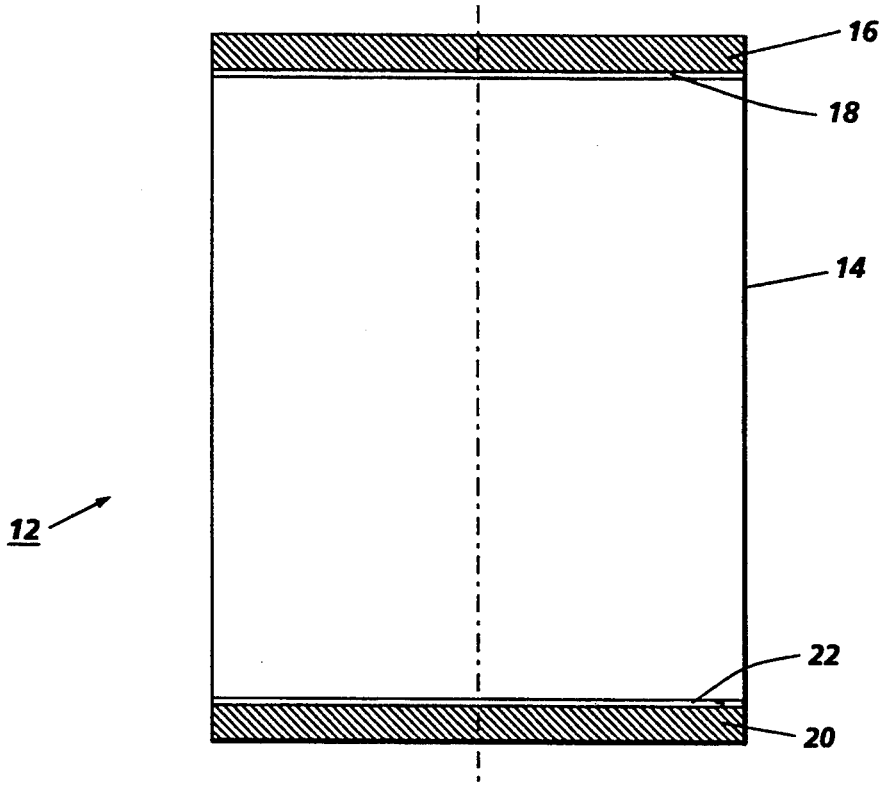
FIG. 2 represents an elevational, schematic view of a multi-section mandrel.

There is provided in embodiments of the present invention a multi-section mandrel. Although the multi-section mandrel is discussed primarily in the context of a three section mandrel, a center portion and two end portions, the present invention in embodiments encompasses a two section mandrel, a center portion and one end portion, when for example only a single thickened end portion is desired. In FIG. 2, multi-section mandrel 12 comprises center portion 14 having an electrically conductive surface, first end portion 16 having an electrically conductive surface, first electrically insulating layer 18 disposed between center portion 14 and first end portion 16, second end portion 20 having an electrically conductive surface, and second insulating layer 22 disposed between center portion 14 and second end portion 20. The insulating layers (18,22) minimize or eliminate electrical conductivity between the center portion 14 and the end portions (16,20). Each mandrel section (14,16,20) may be partially or fully hollow, and has an effective cross sectional shape including cylindrical and oval. The mandrel preferably has parallel sides. Each mandrel section may have the same or different outer cross sectional dimension, preferably ranging from about 5 cm to about 200 cm. In preferred embodiments, to facilitate removal of the article from the mandrel 12, first end portion 16 may have an outer cross sectional dimension exceeding that of center portion 14 by an amount ranging from about 1 mm to about 1 cm, and more preferably from about 2 mm to about 5 mm, and second end portion 20 may have an outer cross sectional dimension smaller than that of center portion 14 by an amount ranging from about 1 mm to about 1 cm, and more preferably from about 2 mm to about 5 mm.

The insulating layers (18,22) may have the same or different thicknesses and compositions from each other. Each insulating layer has an effective thickness ranging for example from about 1 to about 15 microns, preferably less than about 10 microns, and more preferably from about 2 to about 8 microns. Each insulating layer may comprise an electrically nonconductive material such as TEFLON TM, polyethylene, $Al_2O_3$-ceramic, silicon rubber like Dow Corning RTV TM, and MICROMASK STOP-OFF LACQUER TM available from MicroProducts, Tolber Division. The phrase "insulating layer" and similar terms also encompass poorly electrically conductive materials which have conductivities ranging for example from about $1.07\times10^5$ mho/cm to $1\times10^{-19}$ mho/cm. Illustrative examples of poorly conductive materials include glasses which fall within the above conductivity range and graphite.

The multi-section mandrel may be fabricated by a variety of methods. Illustrative methods include the following steps: providing the mandrel center portion and the two end portions by cutting off two mandrel end portions from a single piece mandrel or by supplying three preformed sections; applying the insulating layers to each end of the mandrel center portion by any suitable method depending upon the physical properties of the insulating material (for example, spraying if a ceramic were to be used; painting if a paint were to be used; or applying as a solid in a gasket form which would be compressed between the mandrel pieces to hold it in place); joining the mandrel sections by for example employing one or more fastening devices such as screws or bolts fabricated from an electrically nonconductive or poorly conductive material such as those disclosed herein and especially polyvinyl chloride or TEFLON TM. In embodiments, the mandrel sections may be joined by the method of shrink fitting the pieces onto a solid or hollow tube fabricated from an electrically nonconductive or poorly conductive material such as those disclosed herein and especially TEFLON TM. Shrink fitting involves selecting a tube having an outer cross sectional dimension slightly larger than the inner cross sectional dimensions of the mandrel sections, heating the mandrel sections at a temperature ranging for example from about 50° to about 150° C. to expand the mandrel sections to permit them to slip over the tube, and cooling the mandrel sections, which contracts them, thereby shrinking the mandrel sections to tightly fit onto the tube. In embodiments, the mandrel sections may be joined by using an adhesive such as any suitable epoxy like Dow Corning SILICON RTV 734 TM.

In contrast to conventional methods where a mandrel is coupled to a single current generating device, the various sections of the multi-section mandrel may be coupled to different current generating devices to promote the creation of higher current densities at the mandrel end portions than at the mandrel's center portion. For example, the mandrel's end portions may be coupled to a first current generating device and the center portion may be coupled to a second current generating device. In embodiments, the first end portion of the mandrel may be coupled to a first current generating device, the second end portion of the mandrel may be coupled to a second current generating device, and the center portion may be coupled to a third current generating device.

It is believed that the multi-section mandrel will minimize metal deposition on the insulating layers. However, it is further believed that the metal layer of the article will be continuous over the insulating layers due to an edge effect which will thicken the edges of the metal deposition adjacent each insulating layer, wherein the edges of the metal deposition eventually connect to bridge the gap over the insulating layer.

In embodiments, the mandrel may be a single piece or multi-section mandrel having the center portion fabricated with a material imparting a higher electrical resistance per unit area than that of one or both end portions (herein referred to as a "multi-conductive level mandrel"). The resistivity per unit area is determined by the resistivity and thickness of the material. The multiconductive level mandrel may be coupled to a single current generating device in the conventional manner. Although, these mandrels are discussed primarily in the context of two end portions fabricated from materials different than that of the center portion, the present invention in embodiments encompasses mandrels wherein only one end portion is fabricated from a material having a significantly different resistance per unit area than that of the center portion; the other mandrel end portion may be fabricated from a material having the same or similar resistance per unit area as that of the center portion. A mandrel having only one end fabricated from a material having a lower resistance per unit area than that of the center portion may be used for example to form an article having only one thickened end portion. The resistivity of the material used to fabricate the mandrel's center portion preferably exceeds the material used to fabricate the mandrel's end portions by an effective amount, preferably ranging from about 2 to 1000 microohm-cm, and more preferably ranging from about 5 to about 100 microohm-cm. Illustrative materials for the mandrel's center portion (herein referred to as "higher resistance material" or "higher resistivity material") include nickel, chromium, iron, steel, NICROME TM and the like with resistivities of about 7 to about 100 microohm-cm. Illustrative materials for the mandrel's end portions (herein referred to as "lower resistance material" or "lower resistivity material") include copper and aluminum with resistivities of about 1.7 and about 2.8 microohm-cm. The two mandrel end portions may be fabricated from the same or different materials and may have the same or different conductivities.

The multi-conductive level mandrel may be fabricated by a variety of methods. For example, where the mandrel is a multi-section mandrel, the center portion and the two end portions may be shrink fit onto a solid or hollow tube in a method similar to that described above. The tube may be fabricated from an electrically conductive material, preferably a higher conductivity material such as that disclosed herein for the fabrication of the mandrel end portions. The various sections of the mandrel may also be joined together with one or more fastening devices such as screws and bolts, preferably fabricated from a conductive material such as a metal like steel.

Figure 3A:
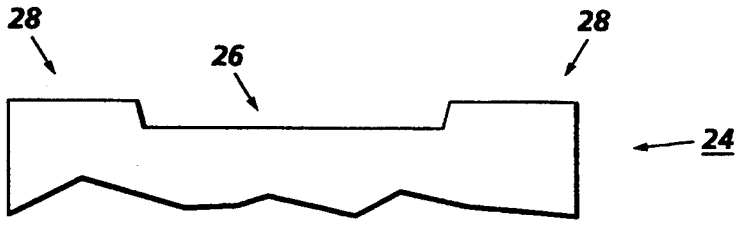
FIGS. 3(*a*), (*b*), and (*c*) represent schematic, cross sectional views of a multi-conductive level mandrel during its fabrication.
Figure 3B:
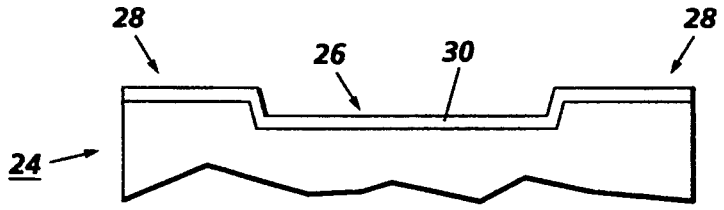
Figure 3C:
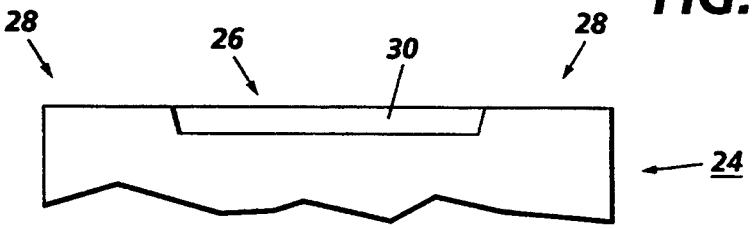

FIG. 3 illustrates a preferred method to fabricate a single piece, multi-conductive level mandrel. In FIG. 3(*a*), a mandrel 24, which is in the form for example of a cylinder and fabricated from a lower resistivity material, is machined on for instance a lathe (not shown) using a cutting tool (not shown) to create a recessed area or center portion 26. The recessed area 26 may be of any effective depth, preferably ranging from about 0.01 mm to about 20 cm, and more preferably about 0.1 mm to about 10 mm. The mandrel's end portions are depicted by the raised areas 28. In FIG. 3(*b*), a layer of higher resistivity material 30 is deposited by for example electroplating or by vacuum deposition over the entire surface of the mandrel 24 to a thickness preferably ranging from about 0.02 mm to about 20 mm, and more preferably from about 0. 1 mm to about 10 mm. In FIG. 3(*c*), the mandrel 24 is machined to smooth its surface and to expose raised areas 28. Center portion 26 contains a layer of higher resistivity material 30 preferably of a thickness ranging from about 0.01 mm to about 1 cm, and more preferably from about 0.1 mm to about 5 mm. In embodiments, the higher resistivity material 30 is deposited only on the recessed area 26 and not on the raised areas 28; machining still may be needed to level or smooth the mandrel surface.

In certain embodiments of the present invention, conventional mandrels may be employed. Conventional mandrels may have any effective design, and may be hollow or solid. The mandrel may have any effective cross-sectional shape such as cylindrical, oval, square, rectangular, or triangular. In embodiments, the mandrel may have tapered sides, but parallel sides are preferred. Suitable mandrels include cylindrically shaped mandrels such as that illustrated in DuPree, U.S. Pat. No. 3,954,568, the disclosure of which is totally incorporated by reference, and mandrels having an ellipsoid or parabolic shaped end, with the mandrel profile preferably like that illustrated in Herbert et al., U.S. Pat. No. 4,902,386, the disclosure of which is totally incorporated by reference. The mandrel may be of any suitable dimensions. For example, the mandrel may have a length ranging from about 5 cm to about 150 cm; and an outside diameter ranging from about 1 cm to about 100 cm. The mandrel may be fabricated from any suitable material, preferably a metal such as aluminum, nickel, steel, iron, copper, and the like.

The mandrels of the instant invention and conventional mandrels may be optionally plated with a protective coating. Typical plated protective coatings for mandrels include chromium, nickel, alloys of nickel, iron, and the like. The plated metal should preferably be harder than the metal used to form the electroform and is of an effective thickness of for example at least about 0.003 mm in thickness, and preferably from about 0.008 to about 0.05 mm in thickness. The outer surface of the plated mandrel preferably is passive, that is for example abhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electrodeposited metal such as nickel. However, other suitable metal surfaces could be used for the mandrels. The mandrel may be plated using any suitable electrodeposition process. Processes for plating a mandrel are known and described in a number of patents. For example, a process for applying multiple metal platings to an aluminum mandrel is described in U.S. Pat. Nos. 4,067,782, and 4,902,386, the disclosures of which are totally incorporated by reference.

The instant invention encompasses any effective method for forming articles having one or two thickened end portions in the end regions. Either coventional mandrels or the novel mandrels disclosed herein may be used in processes of the present invention. For example, the multi-section mandrel and the multi-conductive level mandrel permit metal deposition simultaneously over the entire mandrel surface with additional metal deposition at the end portions due to higher current densities at the end portions. In addition, as discussed above, the multi-section mandrel permits sections of the mandrel to be coupled to different current generating devices. Thus, by timing the activation of the various current generating devices, it is possible in one embodiment to deposit metal on the mandrel end portions prior to the deposit of any metal on the center portion. In this embodiment, metal is first deposited only on the end portions to a thickness ranging for example from about 0.5 mm to about 3 mm, and then commencing metal deposition over the entire mandrel surface.

Figure 4:
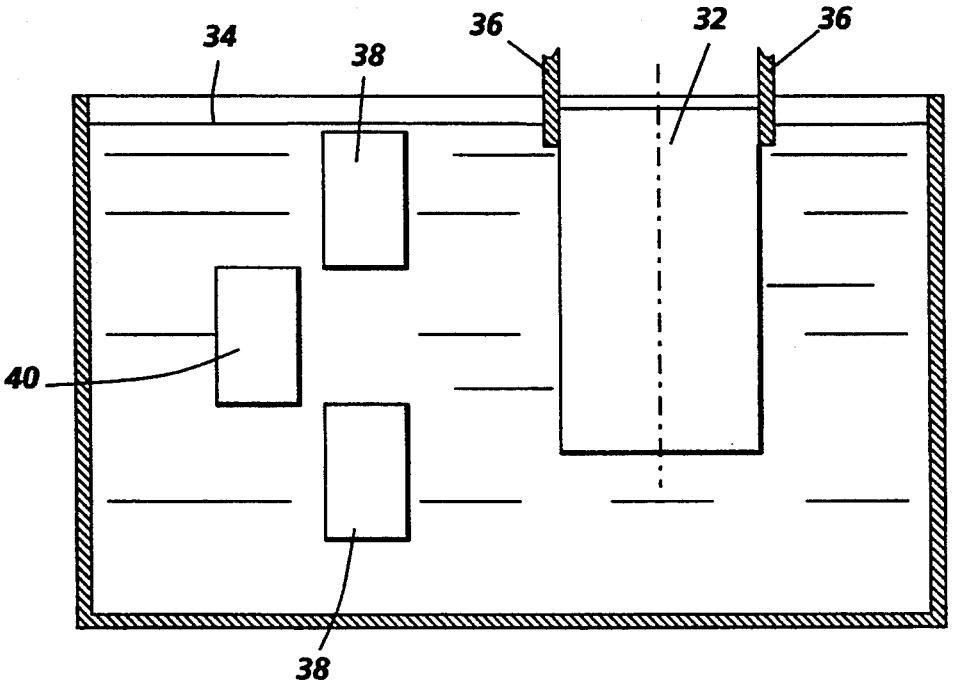
FIG. 4 represents an elevational, schematic view of a particular anode configuration for the formation of an article on a mandrel.

FIG. 4 depicts another method to produce the endless belts of the present invention. In FIG. 4, mandrel 32, which may be a conventional mandrel or a novel mandrel as described herein, is positioned in an electroforming solution 34. Nonconductive mask 36 prevents metal deposition and thus defines the limit of metal deposition on the mandrel 32. Anodes (38,40) are positioned to create a greater current density at the mandrel's end portions than at the center portion. The two closer anodes 38 are preferably spaced from the mandrel surface at a distance ranging from about 3 mm to about 40 mm, and more preferably from about 5 mm to about 15 mm. The farther anode 40 is preferably spaced from the mandrel surface at a distance ranging from about 2 cm to about 10 cm, and more preferably from about 3 cm to about 4 cm. The closer anodes 38 preferably extend beyond the end portion of the mandrel 32 by an effective amount, such as from about 0.5 cm to about 5 cm, and more preferably from about 1 cm to about 3 cm. Extension of the anodes 38 beyond the end portion may create an "edge effect" which promotes increased metal deposition on the mandrel's end portions.

The methods and apparatus of the present invention create a higher current density at the end portions of the mandrel than at its center portion. In embodiments, the current density at the end portions preferably exceeds the current density at the center portion of the mandrel by an amount ranging from about 70 to about 250 amperes per square foot ("ASF"), and more preferably by an amount ranging from about 100 to about 200 ASF. The current density at the center portion of the mandrel preferably ranges from about 100 to about 200 ASF, more preferably from about 125 to about 175 ASF, and especially about 150 ASF. The current density at one or both end portions of the mandrel preferably ranges from about 200 to about 350 ASF, more preferably from about 250 to about 310 ASF, and especially about 300 ASF. The voltage of the current source preferably ranges from about 8 to about 20 volts and more preferably ranges from about 10 to about 17 volts.

A metal layer is deposited over the mandrel in any suitable process including an electrodeposition process, and especially electroplating and electroforming. A typical electrodeposition cycle, especially electroforming, is illustrated in Bailey et al., U.S. Pat. No. 3,844,906, the disclosure of which is totally incorporated by reference. An electroforming cycle is comprised for example of different cells such as the preheat cell, the metal deposition vessel, the solution recovery cell, and the cooling cell.

A preferred electroforming or plating solution follows: Total Deposition Metal (such as nickel or copper): 9.0 to 15.0 oz/gal (the recited concentration for the Total Deposition Metal refers to the metal alone without any counterions and includes the metal component of the halide compound disclosed herein as $MX_2 \cdot 6H_2O$); Deposition Metal (M) Halide (X) as $MX_2 \cdot 6H_2$: 0.11 to 0.23 moles/gal, where M is a metal such as nickel or copper, and X is a halogen such as fluorine, chlorine, iodine, and bromine;and Buffering Agent (such as $H_3BO_3$): 4.5 to 6.0 oz/gal. The metal halide may be any suitable compound typically used in electroforming solutions preferably nickel chloride, nickel bromide, nickel fluoride, copper chloride, copper bromide, and copper fluoride.

Optionally, there is continuously charged to the above solution about 1.0 to $2.0 \times 10^{-4}$ moles of a stress reducing agent per mole of deposition metal electrolytically deposited from the solution. Suitable stress reducing agents include sodium sulfobenzimide (saccharin), 2-methylbenzenesulfonamide, benzene sulfomate, naphthalene trisulfomate, and mixtures thereof.

For continuous, stable operation with high throughput and high yield of acceptable electroformed articles, a nickel sulfamate solution is preferred and is maintained at an equilibrium composition within the electroforming zone. The preferred nickel sulfamate solution comprises: Total Nickel: 10.0 to 14.0 oz/gal (the recited concentration for the Total Nickel refers to the metal alone without any counterions and includes the nickel component of the halide compound disclosed herein as $NiCl_2 \cdot 6H_2O$); Chloride as $NiCl_2 \cdot 6H_2O$: 1.6 to 1.7 oz/gal; $H_3BO_3$: 5.0 to 5.4 oz/gal; Weight Ratio (Chloride as $NiCl_2 \cdot 6H_2O$)/Total Nickel: $0.12 \pm 0.02$; pH: 3.8 to 4.1; and Surface Tension (measured by a Surface Tensionmeter): 33 to 37 dynes/$cm^2$. Additionally, from about 1.3 to $1.6 \times 10^{-4}$ moles of a stress reducing agent per mole of nickel electrolytically deposited from said solution is continuously charged to said electroforming solution.

The electrodeposition solutions are primarily illustrated herein with specific ranges of nickel metal and nickel halide, but it is understood that other metals and metal halides as well as ranges outside those specifically disclosed herein, which may be employed in electrodeposition processes, are encompassed within embodiments of the present invention.

It has been found that the pH can be essentially maintained within the range set forth above by ensuring a steady state concentration of buffering agent in the solution, generally boric acid ($H_3BO_3$), within the range of 5.0 to 5.4 oz/gal.

Control of the surface tension of the electroforming or plating solution may be necessary in order to substantially reduce surface flaws, especially pitting in the electrodeposited article. The surface tension of the solution preferably ranges from about 33 to about 37 dynes/cm$^2$ in order to assure a high rate of production with minimum rejects because of surface flaws. The surface tension of the solution can be maintained within this range by maintaining a steady state concentration of an anionic surfactant such as sodium lauryl sulfate, Duponol 80, a sodium alcohol sulfate, Petrowet R, a sodium hydrocarbon sulfonate (said latter two surfactants being available from E. I. du Pont de Nemours & Co., Inc.), and the like, ranging from 0 to 0.014 oz/gal within the solution, and preferably, by maintaining a steady state concentration of from 0 to 0.007 oz/gal of surfactant therein.

The temperature of the electroforming or plating solution may be between about 100° and 160° F. and preferably is between about 135° and 160° F. Current density supplied by a DC source is for example about 20 to 600 amperes per square foot of mandrel surface.

Because of the effects of both temperature and solution composition on the final product, it is preferred to maintain the electrodeposition solution in a constant state of agitation thereby substantially precluding localized hot or cold spots, stratification and inhomogeneity in composition. Agitation may be obtained by continuous rotation of the mandrel and by impingement of the solution upon the mandrel and cell walls as the solution is circulated through the system. Generally, the solution flow rate across the mandrel surface can range from about 4 to 10 linear feet/second. For example, at a current density of about 300 amps/ft$^2$ with a desired solution temperature range within the cell of about 150° to 160° F., a flow rate of about 15 gal/min of solution may be sufficient to effect proper temperature control. The combined effect of mandrel rotation and solution impingement may assure uniformity of composition and temperature of the electrodeposition solution within the electrodeposition cell.

Further details of the electrodeposition, especially electroforming, solution, apparatus, and methods are illustrated in Bailey et al., U.S. Pat. No. 3,844,906 and Wallin et al., U.S. Pat. No. 3,876,510, the disclosures of which are totally incorporated by reference.

The article with the thickened end portions is removed from the mandrel by any suitable process and apparatus. For example, an effective parting gap may be produced between the mandrel and the article by reliance on differences in thermal coefficients of expansion of the materials employed for the mandrel and the article. Either heating or cooling may be employed to secure the parting gap. Parting gap methods and apparatus are illustrated in Herbert, U.S. Pat. No. 4,501,646; Herbert et al., U.S. Pat. No. 5,167,791; Herbert et al., U.S. Pat. No. 4,902,386; Wallin, U.S. Pat. No. 3,799,859; Bailey et al., U.S. Pat. No. 3,844,906; and DuPree, U.S. Pat. No. 3,954,568, the disclosures of which are totally incorporated by reference. Preferably, the parting gap ranges from about 0.1 mm to about 1 cm, and more preferably from about 0.1 mm to about 5 mm in width.

In embodiments, when the layer of deposited metal has reached the desired thickness, the mandrel and the deposited metal layer, i.e., the article with the thickened end portions, are immersed in a cold water bath. The temperature of the cold water bath is preferably between about 80° F. and about 33° F. When the mandrel is immersed in the cold water bath, the article may be cooled prior to any significant cooling and contracting of the mandrel. Since the article is unable to contract, it may become permanently deformed, so that after the mandrel is cooled and contracted, the article may be easily removed from the mandrel.

Subsequent to removal of the article from the mandrel, one or more of the following layers may be applied to the article: a charge blocking layer, an adhesive layer, photoconductive layer(s) and an anti-curl layer, and any other layer typically employed in a photoreceptor. Components for each of the layers are as described herein and are illustrated for example in Yu, U.S. Pat. No. 5,167,987, the disclosure of which is totally incorporated by reference. The photoconductive or photosensitive layer may be of the laminate type having separate charge generating and charge transporting layers or may be of the single-layer type. Preferred charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, titanyl phthalocyanine, chloro-gallium phthalocyanine, hydroxy-gallium phthalocyanine, vanadyl phthalocyanine, and the like; quinacridone pigments; and azulene compounds. Preferred charge transport materials include compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, aryl amines, and hydrazone compounds. Illustrative photoconductive layers are found in for example Stolka et al., U.S. Pat. No. 4,265,990, the disclosure of which is totally incorporated by reference, which discloses a charge transport layer comprising a polycarbonate resin and an aryl amine. Other typical photoconductive layers include amorphous or alloys of selenium such as selenium-arsenic, selenium-tellurium-arsenic, selenium-tellurium, and the like. The photoconductive layer(s) may be of any suitable thickness. A single layer type photoconductive layer may have a thickness preferably of about 0.1 to about 100 microns. In preferred embodiments, the charge generating and charge transport layers of a laminate type each may have a thickness of about 0.05 microns to about 50 microns.

Some materials can form a layer which functions as both an adhesive layer and charge blocking layer. Typical blocking layers include polyvinylbutyral, organosilanes, epoxy resins, polyesters, polyamides, polyurethanes, silicones, and the like. The polyvinylbutyral, epoxy resins, polyesters, polyamides, and polyurethanes can also serve as an adhesive layer. Adhesive layers, charge blocking layers, anti-curl layers and any other layers conventionally employed in photoreceptors may have an effective thickness, and preferably from about 0.1 to about 20 microns.

The layered materials described herein may be applied by any known technique and apparatus including dip coating, spray coating, electrodeposition, and vapor deposition.. Compositions of the layered materials described herein and techniques and apparatus for their application to the article are illustrated in U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference.

Subsequent to the coating of layered material on the article, one or both end regions of the article may be removed by any suitable method and apparatus including employing a cutting device such as a laser, rotary knife slitter, scissor type shear or electrodischarge machining. Although a portion, such about $\frac{1}{4}$ to about $\frac{3}{4}$, of one or both end regions may be removed in embodiments, it is preferred to remove both end regions in their entirety.

Other modifications of the present invention may occur to those skilled in the art based upon a reading of the present disclosure and these modifications are intended to be included within the scope of the present invention.

We claim:

1. An electrodeposition mandrel comprising:
(a) a center portion having an electrically conductive surface;
(b) a first end portion having an electrically conductive surface disposed in an end to end arrangement adjacent one end of the center portion;
(c) a first electrically insulating layer disposed between the ends of the center portion and the first end portion, whereby the first layer minimizes electrical conductivity between the center portion and the first end portion, wherein there is absent any direct contact between the electrically conductive surface of the first end portion and the electrically conductive surface of the center portion;
(d) a second end portion having an electrically conductive surface disposed in an end to end arrangement adjacent the other end of the center portion; and
(e) a second electrically insulating layer disposed between the ends of the center portion and the second end portion, whereby the second layer minimizes electrical conductivity between the center portion and the second end portion, wherein there is absent any direct contact between the electrically conductive surface of the second end portion and the electrically conductive surface of the center portion, wherein the first electrically insulating layer and the second electrically insulating layer independently have a thickness ranging from about 1 to about 15 microns.

2. An electrodeposition mandrel comprising:
(a) a generally cylindrically shaped center portion comprised of a first electrically conductive material;
(b) a generally cylindrically shaped first end portion comprised of a second electrically conductive material, integral with one end of the center portion, wherein the second material has a higher electrical conductivity than the first material, thereby enabling a thicker deposit of metal on the second material than on the first material; and
(c) a second end portion comprised of a third electrically conductive material, integral with the other end of the center portion, wherein the third material has a higher electrical conductivity than the first material.

3. The mandrel of claim 2, wherein the electrical resistivity of the first material exceeds the second material and the third material by an amount ranging from about 2 to about 1000 microohm-cm.

4. A process comprising:
(a) electroforming on a mandrel a seamless, endless metal article comprised of a center region between a first end region and a second end region, wherein a portion of the first end region and an optional portion of the second end region are at least 1.5 times thicker than the center region;
(b) removing the article from the mandrel;
(c) depositing layered material on the article subsequent to (b); and
(d) removing the first end region and optionally removing the second end region from the article subsequent to (c).

5. The process of claim 4, wherein (a) comprises electroforming the article with thickened end portions having a thickness ranging from about 2 to about 10 times greater than the thickness of the center region.

6. The process of claim 4, wherein (a) comprises electroforming the article with a continuous, thickened band at each end region of the article.

7. The process of claim 4, wherein the mandrel comprises a center portion between two end portions and (a) comprises initiating metal deposition on the two end portions prior to initiating metal deposition on the center portion of the mandrel.

8. The process of claim 4, wherein the mandrel comprises a center portion between two end portions and (a) comprises creating higher current densities at the end portions of the mandrel than at its center portion.

9. The process of claim 4, wherein the mandrel comprises a center portion between two end portions and (a) comprises creating a current density at the end portions of the mandrel which exceeds the current density at the center portion of the mandrel by an amount ranging from about 70 to about 250 amperes per square foot.

* * * * *